United States Patent [19]

Higashigawa et al.

[11] 4,278,618

[45] Jul. 14, 1981

[54] ACCELERATION PUMP FOR A CARBURETOR

[75] Inventors: Keizo Higashigawa; Kazuo Shinoda, both of Toyota, Japan

[73] Assignee: Toyota Jidosha Kogyo Kabushiki Kaisha, Toyota, Japan

[21] Appl. No.: 98,612

[22] Filed: Nov. 29, 1979

[30] Foreign Application Priority Data

Jul. 24, 1979 [JP] Japan ..... 54-102075[U]

[51] Int. Cl.[3] ..... F02M 7/08

[52] U.S. Cl. ..... 261/34 A; 92/140; 417/470; 417/471

[58] Field of Search ..... 261/34 A; 417/470, 471; 92/140

[56] References Cited

U.S. PATENT DOCUMENTS

| | | | |
|---|---|---|---|
| 2,299,863 | 10/1942 | Trisler | 261/34 A |
| 2,345,168 | 3/1944 | Wirth et al. | 261/34 A |
| 2,403,390 | 7/1946 | Moseley et al. | 261/34 A |
| 2,732,193 | 1/1956 | Wentz, Jr. | 261/34 A |
| 2,969,745 | 1/1961 | Johnson et al. | 417/471 |
| 3,764,119 | 10/1973 | Niebrzydoski | 261/34 A |
| 4,075,294 | 2/1978 | Saito et al. | 261/34 A |

FOREIGN PATENT DOCUMENTS

| | | | |
|---|---|---|---|
| 1191630 | 4/1965 | Fed. Rep. of Germany | 261/34 A |
| 52-1337 | 1/1977 | Japan | 261/34 A |
| 332252 | 7/1930 | United Kingdom | 261/34 A |
| 387649 | 5/1931 | United Kingdom | 261/34 A |

*Primary Examiner*—Tim R. Miles

*Attorney, Agent, or Firm*—Stevens, Davis, Miller & Mosher

[57] ABSTRACT

An acceleration pump for a carburetor incorporating first and second pump levers rockably secured to the carburetor body and moved via an acceleration rod connected at one end to the pump lever and a throttle lever connected at one end to the acceleration rod by a throttle valve rockably installed within the barrel of the carburetor, thereby telescopically moving a pump rod secured to a piston of a piston type acceleration pump or to a diaphragm of a diaphragm type acceleration pump. The acceleration pump thus employing the first and second pump levers can obtain an ideal fuel flow curve by increasing the fuel injection time thereof into the air intake opening of the carburetor to improve the exhaust gas purification while improving the drivability and acceleration of a vehicle by preventing a temporarily lean air/fuel ratio of the air/fuel mixture supplied to the carburetor immediately after the acceleration of the vehicle.

5 Claims, 10 Drawing Figures

Q1
Q2
A
B
FLOW RATE
t1
t2
TIME(second)

RICH
R
LEAN
AIR / FUEL RATIO
a
b
ℓ
M
TIME (second)

Q1
Q3
Q4
A
C
D
FLOW RATE
t1
t3
t4
TIME

DISPLACEMENT OF CONTACT END
ℓ2
ℓ1
L2
L1
OPENING OF THROTTLE VALVE

Q5
FLOW RATE
TIME

DISPLACEMENT OF PUMP ROD
ℓ2
ℓ1
L2
L1
t1
t2
t3
TIME

ACCELERATION PUMP FOR A CARBURETOR

BACKGROUND OF THE INVENTION

This invention relates to a carburetor for an automotive internal combustion engine and, more particularly, to improvements of an acceleration pump for the carburetor.

Conventional acceleration pumps are generally classified as a piston type or a diaphragm type. As shown in FIG. 3, which illustrates a conventional piston type acceleration pump provided in a carburetor in cross section, with piston type acceleration pump 20 is provided with its piston 21 telescopically inserted into a cylinder 27 perforated at part of a float chamber 19. This piston 21 is connected directly to a pump rod 22 at one end and further engaged through a pump lever 26 rockably secured to a carburetor body 31, an acceleration rod 25 connected at one end to the pump lever 26, and a throttle lever 24 connected at one end to the acceleration rod 25 with a throttle valve 23 rockably installed within a barrel of the carburetor.

The cylinder 27 is provided with an inlet valve 28 at an inlet passage as a check valve and also with an outlet valve 29 at an outlet passage.

When the throttle valve 23 is opened in a manner publicly known in the conventional carburetor, the piston 21 of the acceleration pump 20 is cooperatively telescopically moved via the linkage of the throttle lever 24, the acceleration rod 25, the pump lever 26, and the pump rod 22 by means of the tension of a coil spring inserted into the cylinder 27. Fuel is injected into the cylinder 27 through the outlet passage, and the outlet valve 29 from an acceleration nozzle 30 protruded into the barrel of the carburetor body 31 into an air intake opening 32, preventing temporary decreasing of the air/fuel ratio of the air/fuel mixture and deterioration of the acceleration of this vehicle due to delayed fuel increase caused by the abrupt increase of intake air stream within the opening 32 when the throttle valve 23 is abruptly opened.

As shown further in FIG. 4, which illustrates a conventional diaphragm type acceleration pump provided in a carburetor in cross section, a diaphragm type acceleration pump 33 is provided with diaphragm 34 expansibly movably mounted within a bore perforated in a carburetor body 31 adjacent to a float chamber 19. This diaphragm 34 is connected directly to a pump rod 35 at one end and further engaged through a pump lever 26 rockably secured to a carburetor body 31, an acceleration rod 25 connected at one end to the pump lever 26, and a throttle lever 24 connected at one end to the acceleration rod 25 with a throttle valve 23 rockably installed within a barrel of the carburetor.

A pump chamber 36 formed within the bore of the carburetor body 31 is provided with an inlet valve 28 in an inlet passage 37 as a check valve and also with an outlet valve 29 in an outlet passage 38, and communicates through the inlet passage with the float chamber 19.

When the throttle valve 23 is opened in a manner generally known in the conventional carburetor, the diaphragm 34 of the accelerator pump 33 is cooperatively expansibly moved through the linkage of the throttle lever 24, the acceleration rod 25, the pump lever 26 and the pump rod 35 against the tension of a diaphragm coil spring 40 inserted into the pump chamber 36 between the bottom of the pump chamber 36 and the diaphragm 34. Thus, fuel is injected into the pump chamber 36 through the outlet passage 38 and the outlet valve 29 from an acceleration nozzle 30 protruded into the barrel of the carburetor body 31 into an air intake opening 32 of the carburetor body 31, thereby preventing the air/fuel ratio of the air/fuel mixture from temporarily decreasing and deteriorating the acceleration of this vehicle due to delayed fuel increase caused by the abrupt increase of intake air stream within the opening 32 when the throttle valve 23 is abruptly opened. An atmospheric air chamber 39 is formed at the outside of the diaphragm 34 and accordingly at the opposite side of the pump chamber 36 in the acceleration pump 33. The pump lever 26 is rockably secured to a fulcrum 41 of the carburetor body 31.

The conventional acceleration pump of both the types incorporates the single pump lever 26 to inject fuel only a short time when the piston 21 of the acceleration pump 20 is pushed down or the diaphragm 34 of the acceleration pump 33 is moved toward the bottom side of the pump chamber 36 leftwardly in FIG. 4 as designated by broken curve A of FIG. 5. Thus fuel is temporarily injected excessively in the amount of fuel flow as indicated by $Q_1$ which is temporarily more than the maximum fuel flow (as designated by $Q_5$ in FIG. 7). Accordingly, this injecting time is too short to compensate the decrease of the air/fuel rario of the air/fuel mixture. In addition, excessive fuel flow is injected temporarily from the acceleration nozzle 30 into the air intake opening 32 of the carburetor, thereby causing deterioration of exhaust gas purification due to unburned gas exhaust, resulting in an increase of fuel consumption.

As shown by curve M in FIG. 8, an automotive engine is abruptly accelerated from the operating state of predetermined air/fuel ratio R with the result that, when the throttle valve is abruptly opened, air stream amount is rapidly increased to increase the negative pressure or vacuum in the air intake opening of the carburetor. Accordingly, fuel is instantaneously taken from a main nozzle into the air/fuel mixture in the air intake opening of the carburetor to cause the air/fuel ratio of the air/fuel mixture to become rich, but not to continuously become rich. The fuel is then delayed, causing the air/fuel ratio of the air/fuel mixture to then become lean, thus allowing the fuel to increasingly inject from the main nozzle gradually to return the fuel to predetermined air/fuel ratio R. This takes several seconds and accordingly insufficient power of the automotive engine is introduced due to the lean air/fuel ratio during this short time and therefore insufficient torque of the engine, causing deterioration of acceleration during this short time.

When the fuel flow injection from the acceleration nozzle shown by curve A in FIG. 5 is superimposed with that from the main nozzle in the carburetor as shown in FIG. 8, an air/fuel ratio becomes as designated by a curve a of broken line to slightly compensate the lean air/fuel ratio of the air/fuel mixture immediately after the acceleration of the automotive engine.

After this acceleration pump is, however, operated, the air/fuel ratio of the air/fuel mixture is temporarily excessively increased. In addition, the curve a in FIG. 8 is remarkably decreased in air/fuel ratio from predetermined value R to thus introduce temporarily lean air/fuel ratio of the air/fuel mixture to cause the fuel flow in the acceleration pump to decrease as shown from the curve a to a curve l. In order to compensate this lean air/fuel ratio of the air/fuel mixture, it is proposed to provide an auxiliary acceleration pump having a diaphragm operated by a vacuum in the air intake opening in addition to the above acceleration pump. This auxiliary acceleration pump operates as designated by curve B in FIG. 5 to inject fuel of small amount $Q_2$ for a longer time $t_2$ so as to compensate the lean air/fuel ratio of the air/fuel mixture as shown by curve b in FIG. 8 by superimposing curve M therewith. Thus, the acceleration pump can improve the performance of the carburetor to the vicinity of the predetermined air/fuel ratio R by superimposing the curve a with the curve b in FIG. 8 in incorporation of the auxiliary acceleration pump. When the curve l is superimposed with the curve b in FIG. 8, it can provide an ideal fuel flow curve as shown in FIG. 7.

Although the deterioration of the acceleration of an automotive engine is improved by the incorporation of the auxiliary acceleration pump with the conventional acceleration pump, it causes complicated construction and accordingly intricate adjustment and maintenance.

There is proposed another type of auxiliary means for utilizing fluid pressure of a flow control valve, (cushion chamber, etc.) in the conventional acceleration pump which operates as designated by a fuel flow curve A in FIG. 5 to adjust the total fuel injection amount of the acceleration nozzle to obtain a fuel injection time in the relationship of $t_1 < t_3 < t_4$ while injecting the fuel in the relationship of $Q_1 > Q_3 > Q_4$ as shown by the curve A to curve C and D in FIG. 6. It is still insufficient due to the lack of fuel flow increase at the start as compared with an ideal fuel flow shown in FIG. 7.

SUMMARY OF THE INVENTION

Accordingly, an object of the present invention is to provide an acceleration pump which can eliminate the aforementioned disadvantages of the conventional acceleration pump and can still obtain an ideal fuel flow curve shown in FIG. 7 with a simple mechanical construction.

Another object of the present invention is to provide an acceleration pump which can obtain an ideal fuel flow curve by increasing fuel injection time thereof into the air intake opening of a carburetor via cooperation with a throttle valve.

Yet another object of the present invention is to provide an acceleration pump which can improve the exhaust gas purification while improving the steering properties and acceleration of a vehicle by preventing a temporary lean air/fuel ratio of air/fuel mixture supplied to the carburetor immediately after the acceleration of the vehicle.

Still another object of the present invention to provide an acceleration pump which can control fuel flow and injection time of fuel injection therefrom by the incorporation of a plurality of pump levers with variable lever ratios and springs.

Still another object of the invention is to provide an acceleration pump which can eliminate complicated mechanism and construction thereof with auxiliary acceleration pump and performance reduction due to the deterioration of its component.

Still another object of the invention is to provide an acceleration pump which can eliminate atmospheric pollution due to unburned exhaust gas discharge caused by excessive fuel flow from higher than necessary acceleration fuel amount during a short time at acceleration of a vehicle.

BRIEF DESCRIPTION OF THE DRAWINGS

The foregoing objects and other objects as well as the characteristic features of the invention will become more apparent and more readily understandable by the following description and the appended claims when read in conjunction with the accompanying drawings.

DETAILED DESCRIPTION OF THE PREFERRED EMBODIMENTS

Figure 1:
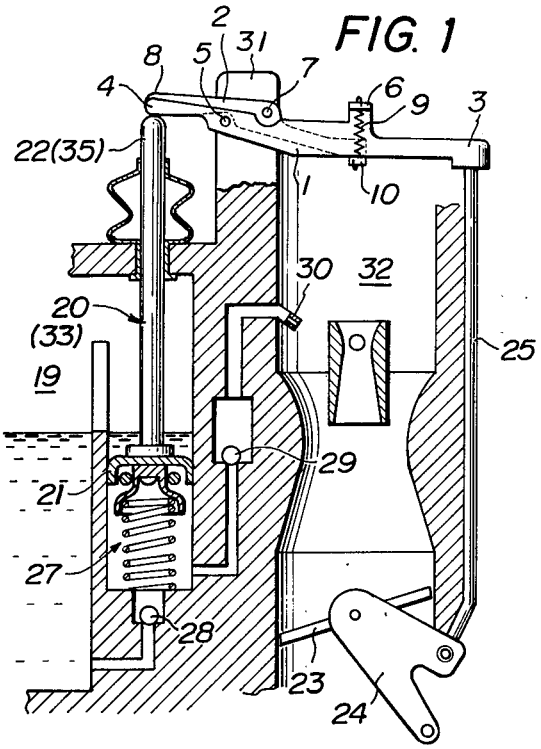
FIG. 1 is a sectional side view of a first embodiment of the acceleration pump constructed according to the present invention.

Referring now to the drawings, particularly to FIG. 1 showing one preferred embodiment of the acceleration pump constructed according to the present invention, the acceleration pump of the present invention incorporates first and second pump levers 1 and 2. The first pump lever 1 has one end 3 connected to the acceleration rod 25 moved via the throttle lever 24 by the throttle valve 23 and the other contact end 4 making contact with the pump rod 22 or 35, and is rockably secured to a fulcrum 5 of a carburetor body. This first pump lever 1 also has a connecting seat 6 provided at the intermediate portion thereof in the vicinity of the one end 3.

The second pump lever 2 is rockably secured to a fulcrum 7 of the carburetor body which is positioned nearer the acceleration rod 25 (spaced from the pump rod 22 or 35) than the pump lever 1 is and has one contact end 8 making contact with the pump rod 22 or 35 in the same manner as the first pump lever 1 and the other end 10 connected via a spring 9 to the seat 6 of the first pump lever 1.

Figure 2:
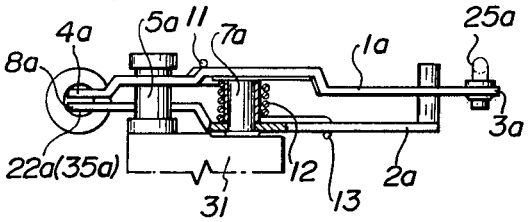
FIG. 2 is a plan view of second embodiment of the essential portion of an acceleration pump constructed according to the present invention.
Figure 3:
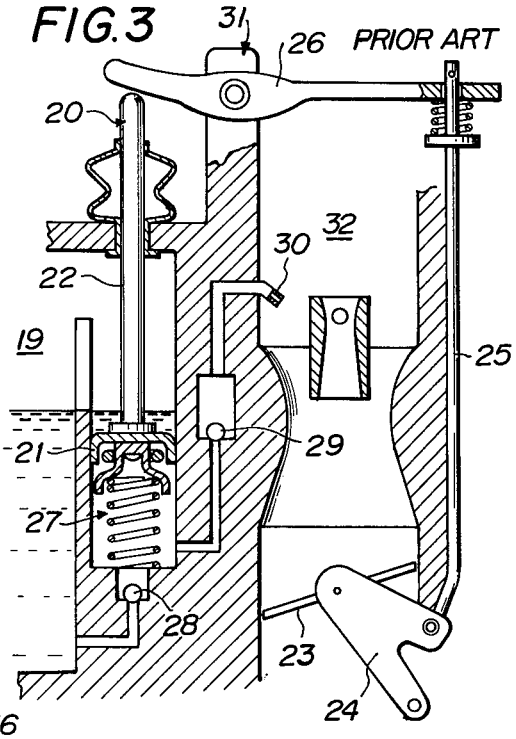
FIG. 3 PRIOR ART
FIG. 3 is a sectional view of a conventional piston type acceleration pump provided in a carburetor.

In FIG. 2, showing a second embodiment of the acceleration pump of the present invention, the acceleration pump of this invention incorporates first and second pump levers 1*a* and 2*a* in the same manner as the first embodiment. The pump lever 1*a* has one end 3*a* connected to the acceleration rod 25*a* and the other contact end 4*a* making contact with the pump rod 22*a* or 35*a*, and is rockably secured to a fulcrum 5*a* of a carburetor body 31.

The second pump lever 2*a* is rockably secured to a fulcrum 7*a* of the carburetor body 31, which is positioned nearer to the acceleration rod 25*a* (spaced from the rod 22*a* or 35*a*) than the fulcrum 5*a* is, and has one contact end 8*a* making contact with the pump rod 22*a* or 35*a* and the other end 13 connected with second end 11, provided at the one end 3*a* side of the first pump lever 1*a*, via a spring 12 rotatably supported around the fulcrum 7*a* between the second end 11 and the other end 13.

In operation of the acceleration pump thus constructed with the advantageous pump levers 1 and 2, when the throttle valve 23 is abruptly opened to accelerate the vehicle with respect to the pump levers of first embodiment, the throttle lever 24 is rotated counterclockwise to move the acceleration rod 25 upwardly in FIG. 1 so as to push up the one end 3 of the pump lever 1. Accordingly, the pump lever 1 is rocked counterclockwise around the fulcrum 5 with the result that the other contact end 4 of the pump lever 1 is moved downwardly to push down the pump rod 22 or 35 so as to move the piston 21 or to compressively move the diaphragm 34 in FIG. 4. Thus, fuel is injected through the outlet valve 11 in the outlet passage from the acceleration nozzle 30 into the air intake opening 32 of the carburetor body 31.

When the pump lever 1 is rocked counterclockwise as above, the contact end 10 of the pump lever 2 is moved upwardly via the spring 9 to cause the pump lever 2 to rock counterclockwise around the fulcrum 7 to allow the contact end 8 to move downwardly so as to push down the pump rod 22 or 35 in addition to the pushing down operation of the contact end 4 of the pump lever 1.

Figure 4:
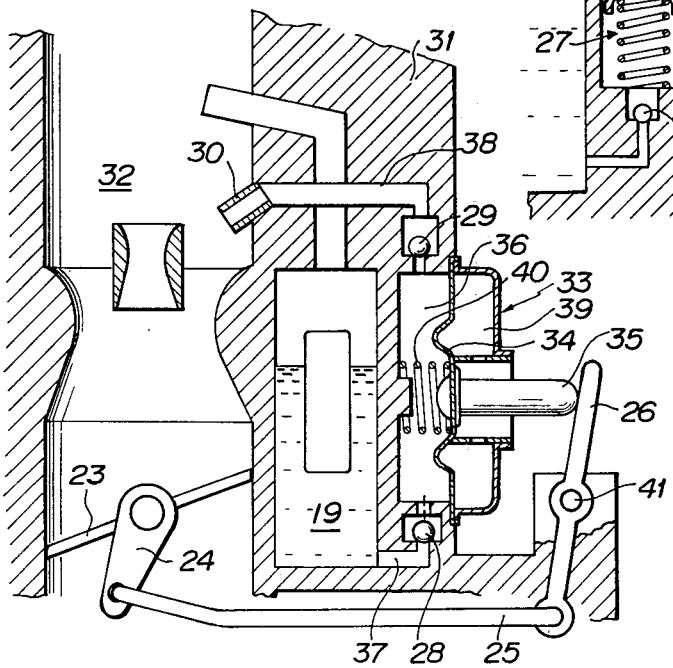
FIG. 4 PRIOR ART
FIG. 4 is a sectional view of another conventional diaphragm type acceleration pump provided in a carburetor.
Figure 5:
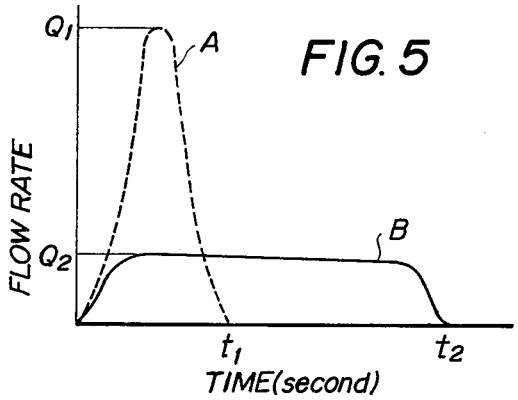
FIG. 5 is a graph showing fuel flow curves of the conventional acceleration pump.
Figure 8:
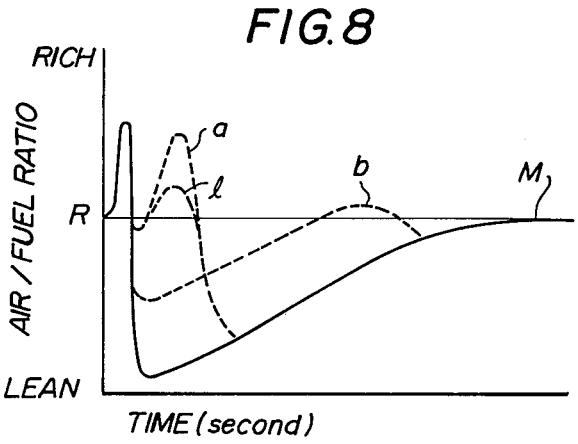
FIG. 8 is a graph showing air/fuel ratio curves of various acceleration pumps.
Figure 6:
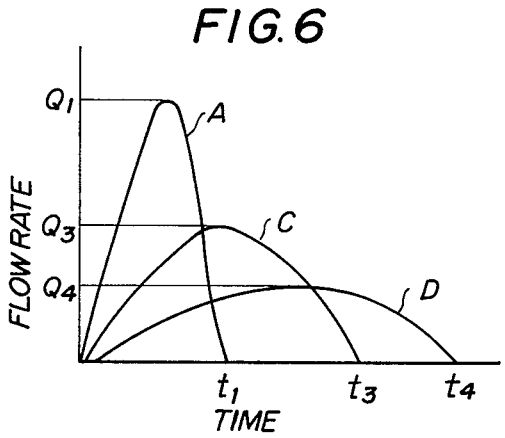
FIG. 6 is a graph showing fuel flow curves of controlled conventional acceleration pump.
Figure 9:
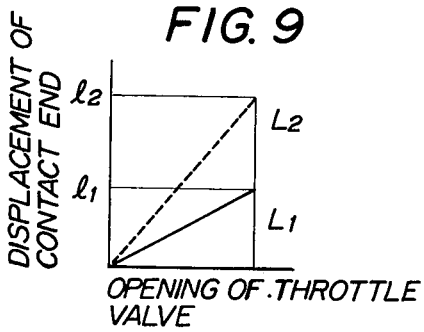
FIG. 9 is a graph showing a static operation diagram of the pump lever of the acceleration pump of this invention.

When no resistance occurs in the movements of the pump rod 22 or 35, for instance, when the acceleration pump 20 or 33 in FIG. 4 is vacant, or when the one end 3 of the pump lever 1 is steadily rockably moved by the acceleration rod 25, the contact end 4 of the pump lever 1 is rockably displaced as designated by solid line $L_1$ in FIG. 9 while the contact end 8 of the pump lever 2 is rockably displaced as designated by a broken line $L_2$ in FIG. 9.

As shown in FIG. 1, since the fulcrum 7 is located in the vicinity of the other end 10 side of the fulcrum 5, the displacement $l_2$ of the contact end 8 of the pump lever 2 is larger than the $l_1$ of the contact end 4 of the pump lever 1 so that the pump rod 22 or 35 is depressed down by the pump lever 2 longer than the depressing stroke of the pump lever 1, thereby giving the pump rod 22 or 35 no opportunity to make contact with the pump lever 1 except for the initial rocking operation.

Figure 10:
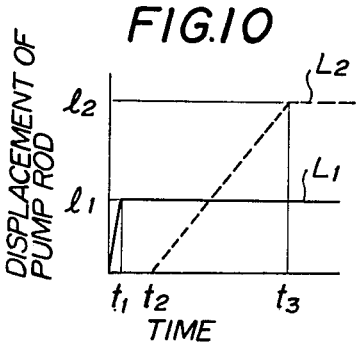
FIG. 10 is a graph showing the dynamic operation diagram of the pump lever of the acceleration pump of the invention.

When resistance exists in the movements of the pump rod 22 or 35, for example, when fuel is filled in the acceleration pump 20 or 33 and the throttle valve 23 is abruptly opened, namely, when the acceleration rod 25 abruptly pushes up the one end 3 of the pump lever 1, the pump lever 1 is immediately rocked to push the pump rod 22 or 35 by the contact end 4 of the pump lever 1 as shown by the solid line $L_1$ in FIG. 10 until the throttle valve 23 is fully opened at time $t_1$. This operates the acceleration pump 20 or 33 so as to inject partly fuel for acceleration in the cylinder 27 or pump chamber 36 initially from the acceleration nozzle 30.

Then, the pump lever 1 is continuously rocked to further push the pump rod 22 or 35 slowly by the contact end 4 of the pump lever 1 via the contact end 8 of the pump lever 2 from the time $t_2$ to the time $t_3$ as designated by a broken line $L_2$ in FIG. 10 by the pump lever 2. Pump lever 2 is rocked in delay from the time $t_2$ by means of the inertial force, resistance force and tension of the spring 9 or the like so as to inject the acceleration fuel continuously from the acceleration nozzle 30.

Figure 7:
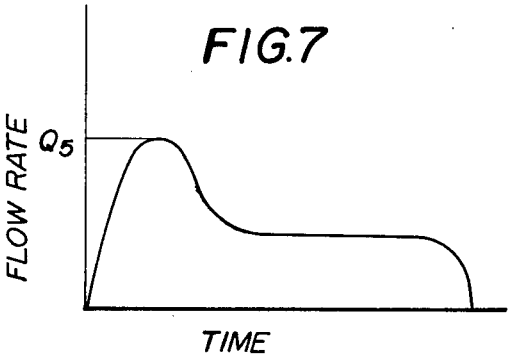
FIG. 7 is a graph showing an ideal fuel flow curve.

The fuel injection amount of the pump lever 1 and the fuel injection amount of the pump lever 2 can be selectively determined by selecting the lever ratio of the length of the pump lever 1 to that of the pump lever 2 as predetermined from the positions of the fulcrums 5 and 7. Thus the acceleration pump 20 or 33 can inject the acceleration fuel as designated by an ideal flow rate curve shown in FIG. 7.

When a plurality of the pump levers 2 are thus provided, the acceleration pump 20 or 33 can inject the acceleration fuel in a manner more similar to the ideal flow rate curve. In addition, the acceleration pump can further obtain another flow rate curve required by the automotive engine by suitably selecting the number of the pump levers, the lever ratio, and tension of the spring or the like.

Before the acceleration pump 20 or 33 employing the pump levers 1 and 2 is operated, only the contact end 4 of the pump lever 1 makes contact with the pump rod 22 or 35. The contact end 8 of the pump lever 2 does not make contact with the pump rod 22 or 35 but is retained in space therebetween to thereby enable the pump lever 2 to rock in delay from the rocking operation of the pump lever 1 and push the pump rod 22 or 35 so as to similarly inject the acceleration fuel according to the ideal flow rate curve shown in FIG. 7.

It should be noted from the foregoing description that, since the acceleration pump of the present invention can completely compensate the temporarily lean air/fuel ratio of the air/fuel mixture, namely the deterioration of the drivability and acceleration of the vehicle due to the delay in the fuel flow from the main nozzle caused by the air flow rate increase in the air intake opening of the carburetor due to the abrupt opening of the throttle valve merely by a single accelerattion pump without the conventional auxiliary pump, it can prevent excessive fuel injection from the acceleration pump so as to improve the exhaust gas purification.

It should be appreciated that, since the first embodiment of the acceleration pump of the present invention utilizes the tension of the spring 39 and the second embodiment thereof utilizes the twisting tension of the coil spring 42, the acceleration pump employing the second embodiment of the present invention can also perform the same advantages as described above for the first embodiment.

It should also be understood that since the acceleration pump of the present invention is thus constructed and operated as described previously, even a single acceleration pump can control the fuel flow rate and time in the injection from the acceleration nozzle thereof by employing a plurality of driving pump levers, varying the lever ratio, and engaging via the spring; can completely prevent the temporarily very lean air/fuel ratio of the air/fuel mixture at accelerating time of the vehicle; can completely eliminate the troubles of complicated mechanism with the conventional auxiliary acceleration pump, the decrease of the performance thereof due to the deterioration of the components of the auxiliary acceleration pump; and can also eliminate the problems of atmospheric pollution due to the unburned exhaust gas discharge or the like based on the excessive fuel flow more than necessary amount of acceleration fuel from the acceleration nozzle into the air intake opening of the carburetor for short time at accelerating time of the vehicle.

What is claimed is:

1. An acceleration pump for a carburetor having a barrel, fuel pumping means, a pump rod slidably secured to the pumping means, an acceleration rod having first and second ends longitudinally movably provided at the carburetor body, a throttle lever having first and second ends rockably secured at said first end to said first end of said acceleration rod, and a throttle valve rockably installed within the barrel of the carburetor and also secured to the second end of the throttle lever, comprising:

a first rockable member secured to a first fulcrum of the carburetor body and having a first contact end connected to the acceleration rod movable via the throttle lever and the throttle valve and a second contact end making contact with the pump rod; and a second rockable member secured to a second fulcrum of the carburetor body at the position substantially nearer to the acceleration rod apart from the pump rod and having a first contact end making contact with the pump rod in the same manner as said first rockable member and a second end connected via a spring to said first rockable member.

2. The acceleration pump according to claim 1, wherein said first rockable member has a connecting seat provided at the intermediate portion thereof in the vicinity of the first end thereof, and said second rockable member has the second end connected via a spring to the seat of said first rockable member.

3. An acceleration pump for a carburetor having a barrel, fuel pumping means, a pump rod slidably secured to the pumping means, an acceleration rod having first and second ends longitudinally movably provided at the carburetor body, a throttle lever having first and second ends rockably secured at said first end to said first end of said acceleration rod, and a throttle valve rockably installed within the barrel of the carburetor and also secured to the second end of the throttle lever, comprising:

a first rockable member rockably secured to a first fulcrum of the carburetor body and having a first contact end connected to the acceleration rod and a second contact end making contact with the pump rod; and a second rockable member secured to a second fulcrum of the carburetor body at a position nearer to the acceleration rod then the first fulcrum and spaced apart from said acceleration rod, having a first contact end making contact with the pump rod and a second contact end connected with the acceleration rod side of said first rockable member via a spring rotatably supported around said second fulcrum.

4. The acceleration pump according to claim 1 or claim 3, wherein the second fulcrum of said second rockable member is located in the vicinity of the second contact end side of the first fulcrum of said first rockable member whereby the displacement of the first contact end of said second rockable member is larger than that of the second contact end of said first rockable member so that the pump rod is depressed down by said second rockable member longer than the depression stroke by said first rockable member thereby causing the pump rod to make no contact with said first rockable member except for the initial rocking operation.

5. The acceleration pump according to claim 1 or claim 3, wherein the fuel injection amounts of said first and second rockable members are so selected that said acceleration pump may inject fuel according to an ideal flow rate curve by predetermining the lever ratio of the length of said first rockable member to that of said second rockable member from the positions of the first and second fulcrums of the first and second rockable members, respectively.

* * * * *